US005664970A

United States Patent [19]

Millhimes et al.

[11] Patent Number: 5,664,970

[45] Date of Patent: Sep. 9, 1997

[54] COMPLIANT SECTION FOR ELECTRICAL TERMINAL MOUNTED TO A CIRCUIT BOARD

[75] Inventors: Wayne Leroy Millhimes, Hershey; Charles Dudley Copper, Harrisburg, both of Pa.

[73] Assignee: The Whitaker Corporation, Wilmington, Del.

[21] Appl. No.: 610,097

[22] Filed: Feb. 29, 1996

[51] Int. Cl.[6] ..... H01R 13/42

[52] U.S. Cl. ..... 439/751; 439/873

[58] Field of Search ..... 439/751, 81, 873

[56] References Cited

U.S. PATENT DOCUMENTS

| | | | |
|---|---|---|---|
| 3,545,080 | 12/1970 | Evans | 439/751 |
| 3,634,819 | 1/1972 | Evans | 439/751 |
| 4,286,837 | 9/1981 | Yasutake et al. | 439/176 MP |
| 4,513,499 | 4/1985 | Roldan | 439/733.1 |
| 4,923,414 | 5/1990 | Sitzler | 439/751 |

FOREIGN PATENT DOCUMENTS

| | | | |
|---|---|---|---|
| 62-139384 | 6/1987 | Japan | H01R 9/09 |

*Primary Examiner*—Neil Abrams
*Assistant Examiner*—T. C. Patel

[57] ABSTRACT

An improved compliant section (30) for a terminal connectable to a circuit board (54), the compliant section (30) having legs (32) with outer edges (34) thereof forming selected shapes axially therealong and an elongate hole (38) having a selected shape stamped transversely through the terminal separating the legs (32) and defined between inwardly facing edges (36) thereof. The selected shapes of the leg outer edges (34) are continuous surfaces, first diverging then converging toward an insertion end (40) of the terminal and having a widest dimension at a selected axial location. The hole (38) has first and second ends (42, 44) and a transverse median M at a selected axial location. The hole (38) is offset axially with respect to outer edges (34) of the compliant section (30) such that the transverse median M of the hole (38) is staggered axially with respect to the widest dimension of the outer edges (34) of legs (32) and such that the width of each leg (32) between outer and inner edges (34, 36) at the first end (42) of the hole (38) is less than the width of each leg (32) at the opposite second end (44) of the hole (38).

2 Claims, 1 Drawing Sheet

COMPLIANT SECTION FOR ELECTRICAL TERMINAL MOUNTED TO A CIRCUIT BOARD

FIELD OF THE INVENTION

This invention relates to electrical terminals having compliant sections that are used for mounting terminals in plated through-holes of circuit boards.

BACKGROUND OF THE INVENTION

Electrical connectors having a plurality of terminals disposed therein and having a compliant section adapted for electrical engagement with through-holes of circuit boards are used throughout the electronic industry. In many applications it is desirable that the connectors be secured to the circuit boards by means of a compliant section on each of the terminals such that the terminals may be pressed fit into respective plated through-holes for electrical engagement therewith and concomitantly retain the connector on the circuit board. Such connections, therefore, do not require soldering thus making the connector more cost effective to manufacture.

The elimination of the soldering also permits the mounting of some connectors to circuit boards by applying a force directly to the top surface of the connector or with a tool directed to apply force to the individual terminals within the housings. To meet the demands of the industry for high density connectors, the arrays of terminals have gotten closer together and the thickness of the stock used for making the terminals has gotten thinner. Terminals having compliant sections made from the thinner stock, however, are more susceptible to buckling when the connector is mounted to a circuit board. It is desirable, therefore, to provide a compliant section that has sufficient strength to withstand buckling forces as the terminals of the connector are inserted into the through-holes of the circuit board. It is further desirable that the insertion force be such that the terminals will not bend upon insertion and the compliant section will have sufficient resistance against extraction to hold the connector securely to the board.

SUMMARY OF THE INVENTION

The present invention is directed to an improved compliant section for a terminal connectable to a circuit board, which has a low insertion force and a high extraction force. The compliant section of the present invention is of the type having legs with outer edges thereof forming selected shapes axially therealong and an elongate hole having a selected shape stamped transversely through the terminal separating the legs and defined between inwardly facing edges thereof. The oppositely facing leg outer edges are adapted to enter and become engaged with sidewalls of the through-hole in an interference fit to create force for retaining the terminal's compliant section in the through-hole and the terminal to the circuit board. The selected shapes of the leg outer edges are continuous surfaces, first diverging then converging toward an insertion end of the contact and have a widest dimension at a selected axial location. The hole is formed from inwardly facing edges between first and second ends and has a transverse median at a selected axial location. In the improved compliant section the hole is offset axially with respect to outer edges of the compliant section such that the transverse median of said hole is staggered axially with respect to the widest dimension of the outer edges of the legs. The width of each leg between outer and inner edges at the first end of the hole is less than the width of each leg at the opposite second end of the hole.

In the preferred embodiment, the second hole end is formed with wider leg widths remote from the insert end thereby providing resistance against buckling of the terminal body section.

It is an object to the invention to provide a compliant terminal section suitable for terminals in high density electrical connectors that has a low insertion force, resists buckling upon being inserted into the circuit board and has a high retention force to securely hold the connector to the board.

An embodiment of the invention will be described by way of example with reference to the accompanying drawings.

DETAILS OF THE PREFERRED EMBODIMENT

Figure 3:
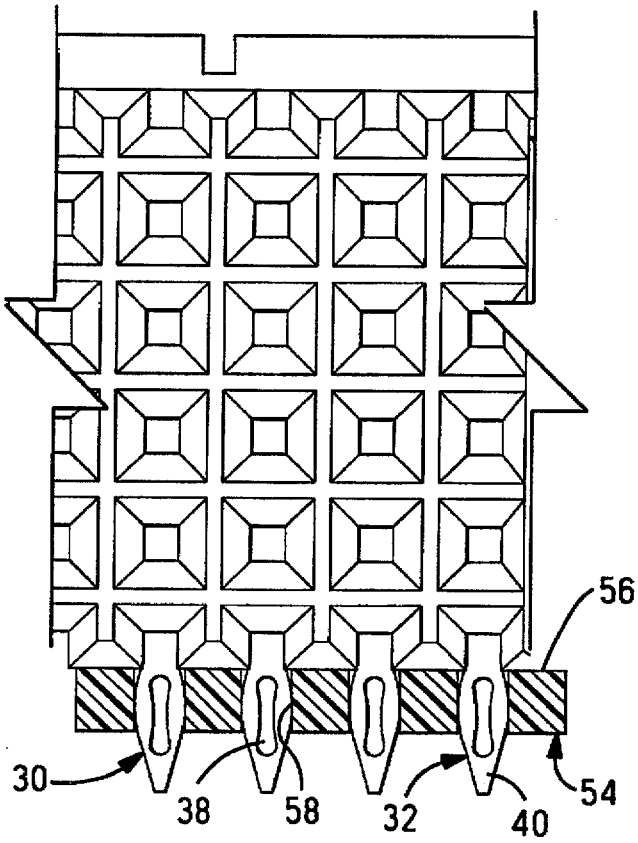
FIG. 3 is a front plan view of a fragmentary portion of an electrical connector having an array of terminals with compliant sections mounted to a circuit board.

For purposes of illustrating the invention the compliant terminal section is shown representatively in an electrical connector 50 of FIG. 3. Connector 50 is a right angle connector having an array of terminals (not shown), each having a compliant section 30 made in accordance with the invention for engaging side surfaces 58 of through-holes 56 in a circuit board 54. The terminals for such connectors are typically stamped from metal stock having a thickness in the range of 0.006 to 0.015 inches.

The shape and length of the compliant section and the opening therein is determined by the size of the through-hole, the thickness of the circuit board, the desired insertion force required for inserting an individual terminal in a through-hole or for mounting an entire connector to a board, and the desired withdrawal force for removing the terminal or connector from the board.

Figure 1:
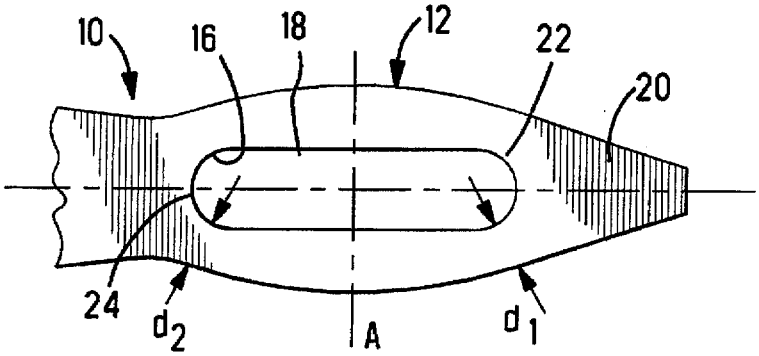
Fig. 1 PRIOR ART
FIG. 1 is a flat plan view of a compliant section of the prior art.

FIG. 1 illustrates a general shape of a prior art compliant section 10 for a terminal. The compliant section is of the type having legs 12 with outer edges 14 thereof forming a selected shape axially therealong and an elongate hole 18 having a selected shape stamped transversely through the terminal separating the legs 12 and defined between inwardly facing edges 16 thereof. The oppositely facing leg outer edges 14 are adapted to enter and become engaged with side surfaces of a through-hole in an interference fit to create force for retaining the terminal's compliant section in the through-hole and the terminal to the circuit board. The selected shapes of the leg outer edges 14 is continuous, first diverging then converging toward an insertion end 20 of the terminal. The compliant section 10 has a widest dimension at a selected axial location shown as line A. The hole 18 is formed from inwardly facing edges between first and second ends 22,24, respectively and has a transverse median at the same selected axial location (line A) as the legs 12. In the resulting structure as can be seen in FIG. 1, the width $d_1$ of each portion of leg 12 between outer and inner edges 14, 16 at the first end 22 of hole 18 is equal to the width $d_2$ of each portion of leg 12 at the opposite or second end 24 of hole 18.

Figure 2:
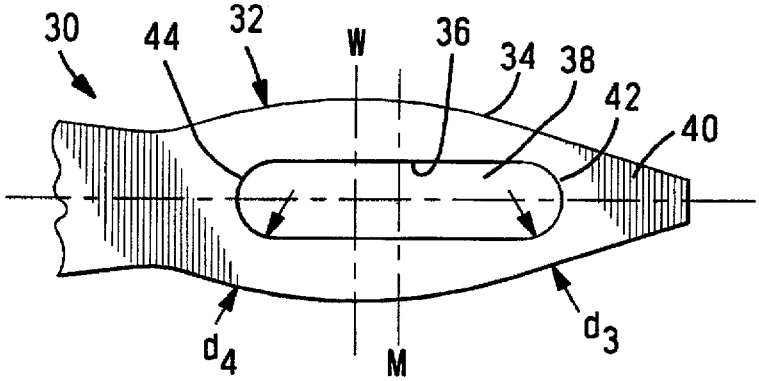
FIG. 2 is a flat plan view of a compliant section for a terminal made in accordance with the invention.

The improved compliant section 30 is shown in FIG. 2. Compliant section 30 has legs 32 with outer edges 34 thereof forming a selected shape axially therealong and an elongate hole 38 having a selected shape stamped transversely through the terminal. Hole 38 separates the legs 32 and is defined between inwardly facing edges 36 thereof. The oppositely facing leg outer edges 34 are adapted to enter and become engaged with side surfaces 58 of a through-hole 56 in an interference fit to create force for retaining the terminal's compliant section 30 in the through-hole 56 and the terminal to the circuit board 54, as illustrated in FIG. 3. The selected shapes of the leg outer edges 34 are continuous, first diverging then converging toward an insertion end 40 of the terminal. The compliant section 30 has a widest dimension at a selected axial location shown as line W. In the improved compliant section 30 of the invention, hole 38 is offset axially with respect to outer edges 34 of the compliant section 30 such that the transverse median shown as line M of hole 38 is staggered axially with respect to the widest dimension, shown as line W, of the outer edges 34 of the legs 32. As can be seen in FIG. 2, the width $d_3$ of each portion of leg 32 between outer and inner edges 34, 36 at the first end 42 of hole 38 is less than the width $d_4$ of each portion of leg 32 at the opposite second end 44 of hole 38.

By moving the axial median M of hole 38 toward the insertion end 40, the wider portions of the legs proximate second hole end 44, have greater strength to resist bending or buckling forces as an individual terminal or an array of terminals in a connector 50 is inserted into the board. Furthermore, the insertion end 40 of the compliant section 30 has a lower insertion force because the forces exerted by the side surfaces 58 of board hole 56 can compress the compliant section 30, as shown in FIG. 3, more readily than the insertion end 20 of the prior art. Upon full insertion of the connector 50 in the board 54 the wider portion of the legs proximate second hole end 44 resists compression and therefore increases the force required to remove the connector from the board.

For purposes of illustrating the invention the elongate hole 38 has been shown as being an oval. It is to be understood that the elongate hole may have other shapes, the critical factor being the shift of the transverse median of the hole toward the tip of the compliant section.

The present invention gives the advantage of lowering the insertion force, protecting the terminals from buckling upon in mass insertion of the high density contact array and increases the withdrawal forces for removing the connector from the board.

It is thought that the improved compliant section of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. An improved compliant section for a terminal connectable to a circuit board, the compliant section extending from a body section of said terminal and being insertable in a through-hole of a selected diameter in the circuit board having a selected thickness, the compliant section being of the type having legs with outer edges thereof forming selected shapes axially therealong and an elongate hole having a selected shape stamped transversely through the terminal separating the legs and defined between inwardly facing edges thereof, said oppositely facing leg outer edges being adapted to enter and become engaged with sidewalls of said through-hole in an interference fit to create force for retaining the terminal's compliant section in the through-hole and the terminal to the circuit board, said selected shapes of said leg outer edges being continuous arcuate surfaces, first diverging then converging toward an insertion end of said terminal and having a widest dimension at a selected axial location; and said hole being formed from parallell inwardly facing edges between first and second ends and having a transverse median at a selected axial location, the improvement comprising:

said hole being offset axially with respect to said outer edges of said compliant section such-that the transverse median of said hole is staggered axially with respect to said widest dimension of said outer edges of said legs and such that at the first end of said hole, the width of each said leg portion between outer and inner edges at said hole first end is less than the width of each said leg portion at said hole second end opposite said hole first end.

2. The improved compliant section of claim 1 wherein said hole second end is remote from said insertion end such that wider leg portion widths thereat provide resistance against buckling of the terminal body section.

* * * * *